US010269299B2

(12) United States Patent
Tseng

(10) Patent No.: US 10,269,299 B2
(45) Date of Patent: Apr. 23, 2019

(54) DISPLAY DEVICE AND METHOD FOR OBTAINING A DATA VOLTAGE TO BE OUTPUT TO ROWS OF PIXEL CIRCUITS

(71) Applicant: BOE TECHNOLOGY GROUP CO., LTD., Beijing (CN)

(72) Inventor: Szu-Heng Tseng, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 31 days.

(21) Appl. No.: 15/307,980

(22) PCT Filed: Feb. 17, 2016

(86) PCT No.: PCT/CN2016/073927

§ 371 (c)(1),
(2) Date: Oct. 31, 2016

(87) PCT Pub. No.: WO2017/049851

PCT Pub. Date: Mar. 30, 2017

(65) Prior Publication Data

US 2017/0270871 A1 Sep. 21, 2017

(30) Foreign Application Priority Data

Sep. 21, 2015 (CN) ..... 2015 1 0603867

(51) Int. Cl.
*G09G 3/30* (2006.01)
*G09G 3/3291* (2016.01)
*G09G 3/20* (2006.01)

(52) U.S. Cl.
CPC ..... *G09G 3/3291* (2013.01); *G09G 3/2003* (2013.01); *G09G 2330/021* (2013.01);
(Continued)

(58) Field of Classification Search
CPC ..... G09G 3/30–3/3291; G09G 2330/00–2330/12; G09G 2340/00–2340/16
See application file for complete search history.

(56) References Cited

U.S. PATENT DOCUMENTS

2006/0202913 A1* 9/2006 Hayafuji ..... G09G 3/3233 345/44
2011/0157133 A1 6/2011 Ogura
(Continued)

FOREIGN PATENT DOCUMENTS

CN 101770751 A 7/2010
CN 102110411 A 6/2011
(Continued)

OTHER PUBLICATIONS

Written Opinion of the International Searching Authority from corresponding PCT Application No. PCT/CN2016/073927, dated Jun. 27, 2016 (4 pages).
(Continued)

*Primary Examiner* — Sanghyuk Park
(74) *Attorney, Agent, or Firm* — Harness, Dickey & Pierce, P.L.C.

(57) ABSTRACT

A display driving method and device, and a display device are provided. The method comprises: obtaining a data voltage to be output to each of successive k rows of pixel circuits by a source driving integrated circuit, where k is an integer and not less than 1; determining a maximum voltage of the data voltage to be output to each of the successive k rows of pixel circuits; determining a magnitude of a power supply voltage required for the source driving integrated circuit to output the data voltages to the successive k rows of pixel circuits in accordance with the maximum voltage; and supplying the required power supply voltage to the source driving integrated circuit in accordance with the determined
(Continued)

magnitude of the required power supply voltage when the source driving integrated circuit outputs the data voltages to the successive k rows of pixel circuits. According to an embodiment of the disclosure, when a power supply voltage required for an actual operation of the source driving integrated circuit is relatively small, the power supply voltage supplied to the source driving integrated circuit is also relatively small, such that power consumption of the source driving integrated circuit can be reduced.

18 Claims, 6 Drawing Sheets

(52) U.S. Cl.
CPC ... *G09G 2330/028* (2013.01); *G09G 2340/06* (2013.01); *G09G 2360/16* (2013.01)

(56) References Cited

U.S. PATENT DOCUMENTS

2013/0147861 A1 6/2013 Kim et al.
2014/0063079 A1* 3/2014 Lee ..... G09G 5/02 345/690
2014/0184655 A1* 7/2014 Jang ..... G09G 3/3208 345/690
2015/0002502 A1* 1/2015 Kim ..... G09G 3/3233 345/212

FOREIGN PATENT DOCUMENTS

| | | | |
|---|---|---|---|
| CN | 102111931 | A | 6/2011 |
| CN | 102714020 | A | 10/2012 |
| CN | 103165066 | A | 6/2013 |
| CN | 103474041 | A | 12/2013 |
| CN | 103559860 | A | 2/2014 |
| CN | 103915078 | A | 7/2014 |
| CN | 104200785 | A | 12/2014 |
| CN | 105118437 | A | 12/2015 |
| EP | 2750124 | A2 | 7/2014 |
| EP | 2858065 | A1 | 4/2015 |
| WO | WO-2011067710 | A1 | 6/2011 |

OTHER PUBLICATIONS

Office Action from corresponding Chinese Application No. 201510603867.0, dated Apr. 1, 2017 (8 pages).

* cited by examiner

DISPLAY DEVICE AND METHOD FOR OBTAINING A DATA VOLTAGE TO BE OUTPUT TO ROWS OF PIXEL CIRCUITS

CROSS-REFERENCE TO RELATED APPLICATION

This application claims priority to Chinese Patent Application No. 201510603867.0 filed on Sep. 21, 2015, the disclosure of which is incorporated herein in its entirety as part of the present application.

FIELD

Exemplary embodiments of the disclosure relate to a display driving method, a display driving device, and a display device.

BACKGROUND

With the increasing attention to energy issues, people began to pay attention to power consumption of the organic light emitting diode (OLED) display device.

The OLED display device includes a power supply module, a source driving integrated circuit (IC), a gate driving IC, and N rows and M columns of pixel circuits, wherein N and M are positive integers, respectively. The gate driving IC is electrically connected with each pixel circuit in each row of pixel circuits by N scanning lines, and the source driving IC is electrically connected with each pixel circuit in each column of pixel circuit through M data lines, wherein the power supply module supplies a power to the source driving IC, gate driving IC and pixel circuit, respectively.

Taking the source driving IC as an example, the existing source driving IC has a power supply voltage which is set in advance, and the power supply module only needs to output a preset power supply voltage to the source driving IC when supplying a power to the source driving IC.

Based on the existing manner of supplying power, power consumption of the power supply for the source driving IC is about 17% to 20% of the total power consumption of the OLED display device through measurement. How to reduce power consumption of the power supply for the source driving IC is one focus to reduce power consumption of the OLED display device.

SUMMARY

Exemplary embodiments of the present disclosure provide a display driving method and device, and a display device. When a power supply voltage required for an actual operation of the source driving integrated circuit is relatively small, the power supply voltage supplied to the source driving integrated circuit is also relatively small, such that power consumption of the source driving integrated circuit can be reduced.

According to a first aspect of the disclosure, there is provided a display driving method, comprising:

obtaining a data voltage to be output to each of successive k rows of pixel circuits by a source driving integrated circuit, where k is an integer and not less than 1;

determining a maximum voltage of the data voltage to be output to each of the successive k rows of pixel circuits;

determining a magnitude of a power supply voltage required for the source driving integrated circuit to output the data voltages to the successive k rows of pixel circuits in accordance with the maximum voltage; and supplying the required power supply voltage to the source driving integrated circuit in accordance with the determined magnitude of the required power supply voltage when the source driving integrated circuit outputs the data voltages to the successive k rows of pixel circuits.

In an embodiment of the disclosure, determining the magnitude of the power supply voltage required for the source driving integrated circuit to output the data voltages to the successive k rows of pixel circuits in accordance with the maximum voltage comprises:

obtaining the magnitude of the power supply voltage required for the source driving integrated circuit to output the data voltages to the successive k rows of pixel circuits by adding a preset voltage to the maximum voltage.

In an embodiment of the disclosure, the preset voltage is greater than or equal to 0.2 V.

In an embodiment of the disclosure, obtaining the data voltage to be output to each of the successive k rows of pixel circuits by the source driving integrated circuit comprises:

obtaining original red, green and blue data corresponding to the successive k rows of pixel circuits;

performing a conversion processing on the obtained original red, green and blue data to obtain converted data; and calculating the data voltage to be output to each of the successive k rows of pixel circuits in accordance with the converted data corresponding to the successive k rows of pixel circuits.

In an embodiment of the disclosure, performing the conversion processing on the obtained original red, green and blue data to obtain converted data comprises:

determining a minimum value of the obtained original red, green, and blue data; and converting the obtained original red, green and blue data into red, green, blue and white data in accordance with the minimum value, wherein a value of the white data is equal to a product of the minimum value and a preset ratio, and values of the converted red, green and blue data are differences of values of the original red, green and blue data and the value of the white data, respectively.

In an embodiment of the disclosure, the method further comprises:

sending the converted data corresponding to the successive k rows of pixel circuits to the source driving integrated circuit before the source driving integrated circuit outputs the data voltages to the successive k rows of pixel circuits.

According to a second aspect of the disclosure, there is provided a display driving device, comprising:

an obtaining module arranged to obtain a data voltage to be output to each of successive k rows of pixel circuits by a source driving integrated circuit, where k is an integer and not less than 1;

a first determination module arranged to determine a maximum voltage of the data voltage to be output to each of the successive k rows of pixel circuits;

a second determination module arranged to determine a magnitude of a power supply voltage required for the source driving integrated circuit to output the data voltages to the successive k rows of pixel circuits in accordance with the maximum voltage; and a supplying module arranged to supply the required power supply voltage to the source driving integrated circuit in accordance with the determined magnitude of the required power supply voltage when the source driving integrated circuit outputs the data voltages to the successive k rows of pixel circuits.

In an embodiment of the disclosure, the second determination module is arranged to:

obtain the magnitude of the power supply voltage required for the source driving integrated circuit to output the data voltages to the successive k rows of pixel circuits by adding a preset voltage to the maximum voltage.

In an embodiment of the disclosure, the preset voltage is greater than or equal to 0.2 V.

In an embodiment of the disclosure, the obtaining module comprises:

an obtaining unit arranged to obtain original red, green and blue data corresponding to the successive k rows of pixel circuits;

a conversion module arranged to perform a conversion processing on the obtained original red, green and blue data to obtain converted data; and a calculating module arranged to calculate the data voltage to be output to each of the successive k rows of pixel circuits in accordance with the converted data corresponding to the successive k rows of pixel circuits.

In an embodiment of the disclosure, the conversion module is arranged to:

determine a minimum value of the obtained original red, green, and blue data; and convert the obtained original red, green and blue data into red, green, blue and white data in accordance with the minimum value, wherein a value of the white data is equal to a product of the minimum value and a preset ratio, and values of the converted red, green and blue data are differences of values of the original red, green and blue data and the value of the white data, respectively.

In an embodiment of the disclosure, the device further comprises a sending module arranged to:

send the converted data corresponding to the successive k rows of pixel circuits to the source driving integrated circuit before the source driving integrated circuit outputs the data voltages to the successive k rows of pixel circuits.

According to a third aspect of the disclosure, there is provided a display device comprising a source driving integrated circuit and the display driving device described as above.

BRIEF DESCRIPTION OF THE DRAWINGS

In order to more clearly illustrate the technical solutions in embodiments of the disclosure or in the prior art, the following drawings to be used in the description of the embodiments or in the prior art will be briefly introduced below. Apparently, the drawings in the following description are only for some embodiments of the disclosure, those of ordinary skill in the art may also obtain other drawings from these drawings, without creative efforts.

DETAILED DESCRIPTION

The technical solution in embodiments of the disclosure will be clearly and completely described in combination with the drawings in the embodiments of the disclosure. Apparently, the described embodiments are merely part of the embodiments of the disclosure, instead of all the embodiments. all other embodiments obtained by those of ordinary skill in the art based on the embodiments of the disclosure without creative work fall within the scope of the disclosure.

In the description of the disclosure, It is to be noted that the orientation or position relations indicated by the terms "upper", "lower", "top", "bottom" and the like are orientation or position relations based on the drawings. They are only used for facilitating and simplifying the description of the disclosure, rather than indicating or implying that the indicated devices or elements must have a specific orientation and are constructed and operated in a specific orientation, and therefore cannot be construed as limiting the disclosure.

Further, in the disclosure, the terms "first", "second" and "third" are for descriptive purposes only, and not to be construed to indicate or imply relative importance. The term "a plurality of" refers to two or more, unless otherwise expressly limited.

In order that the objects, technical solutions and advantages of the disclosure will become more apparent, the embodiments of the disclosure will be described below in further detail in combination with the drawings.

Figure 1:
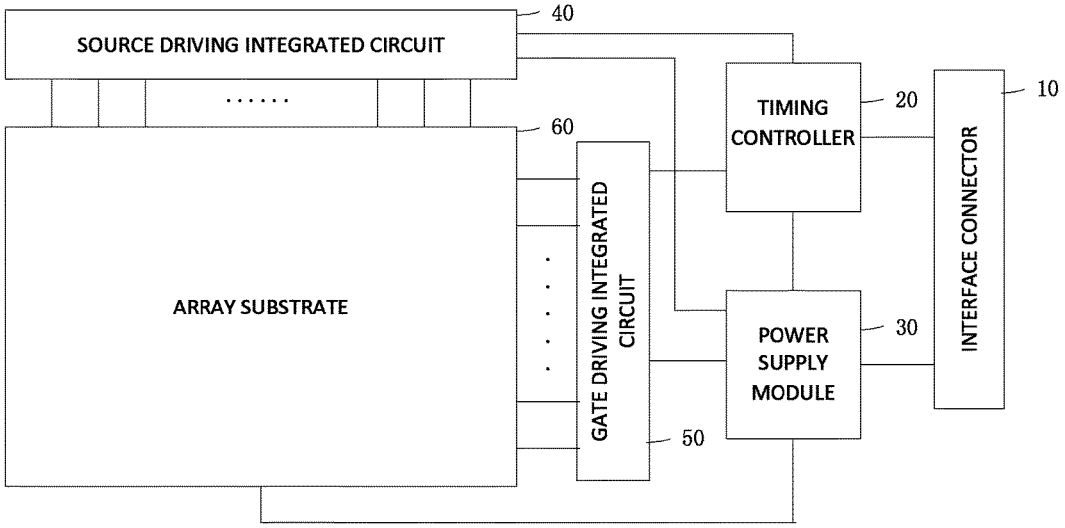
FIG. 1 is a structural block diagram of a module driving circuit of an OLED display device provided according to an embodiment of the disclosure.

In order to facilitate understanding of the technical solutions provided by the embodiments of the disclosure, the module driving circuit of the OLED display device will first be briefly described. Referring to FIG. 1, the OLED display device comprises an interface connector 10, a timing controller 20, a power supply module 30, a source driving integrated circuit (source driving IC) 40, a gate driving IC 50 and an array substrate 60. N rows*M columns of pixel circuits are provided on the array substrate 60, N and M being positive integers, respectively.

The interface connector 10 is connected with the timing controller 20 and the power supply module 30, respectively, to provide image data to be displayed to the timing controller 20 and supply a power to the power supply module 30. The power supply module 30 supplies a power to the timing controller 20, the source driving IC 40, the gate driving IC 50 and each pixel circuit, respectively. The timing controller 20 is connected with the source driving IC 40 and the gate driving IC 50, respectively, to output image data and a controlling signal corresponding to the pixel circuit to the source driving IC 40 and output a controlling signal to the gate driving IC 50. The source driving IC 40 calculates a data voltage of the pixel circuit according to the image data corresponding to the pixel circuit output by the timing controller 20, and outputs the data voltage to the pixel circuit. The gate driving IC 50 outputs a scanning signal to the pixel circuit according to the controlling signal output by the timing controller 20.

Figure 2:
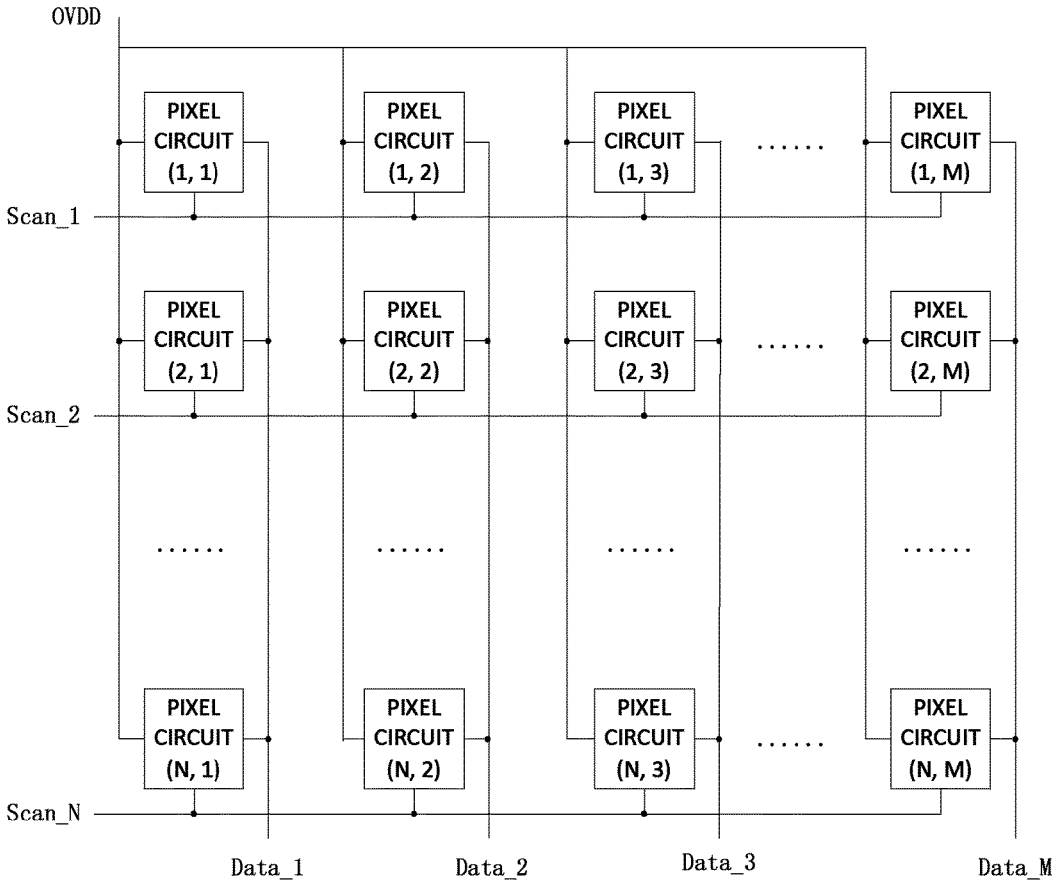
FIG. 2 is a structural schematic diagram of an array substrate provided according to an embodiment of the disclosure.

Referring to FIG. 2, the power supply module 30 is connected with each pixel circuit through a power supply line OVDD to provide a driving voltage to each pixel circuit. The gate driving IC 50 is connected with each pixel circuit of each row of pixel circuits through N scanning lines. The source driving IC 40 is connected with each pixel circuit of each column of pixel circuits through M data lines. For example, a first row of pixel circuits comprise M pixel circuits of a pixel circuit (1, 1), a pixel circuit (1, 2), . . . , a pixel circuit (1, M) which are commonly connected to a scanning line Scan_1. A first column of pixel circuits comprise N pixel circuits of a pixel circuit (1, 1), a pixel circuit (2, 1), . . . , a pixel circuit (N, 1) which are commonly connected to a data line Data_1. When the first row of pixel circuits are operating, the gate driving IC 50 inputs a scanning signal to the scanning line Scan_1 to turn on the first row of pixel circuits; the source driving IC 40 inputs a data voltage to N data lines synchronously to provide a data voltage to each pixel circuit of the first row of pixel circuits which are turned on, respectively. The magnitude of the driving current of each pixel circuit of the first row of pixel circuits is determined by the data voltage of the corresponding pixel circuit, thereby realizing adjustment of brightness of each pixel circuit.

It is to be noted that the structure of the pixel circuit is not limited in this embodiment, and the configuration of the pixel circuit may be the same as that of the conventional pixel circuit.

Figure 3:
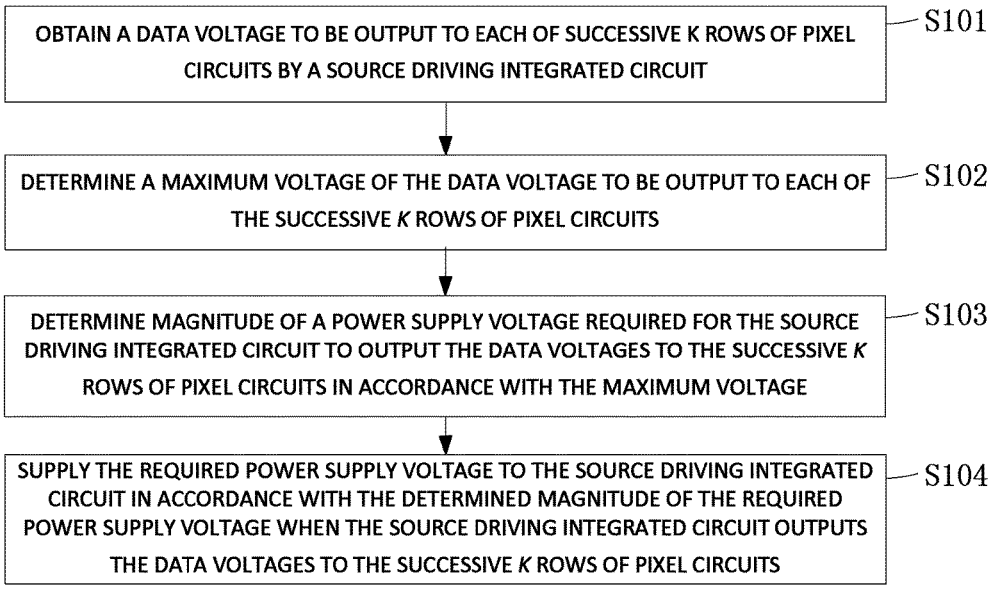
FIG. 3 is a flowchart of a display driving method provided according to one embodiment of the disclosure.

FIG. 3 shows a display driving method according to one embodiment of the disclosure. Referring to FIG. 3, the method comprises the following steps:

Step S101, obtaining a data voltage to be output to each of successive k rows of pixel circuits by a source driving integrated circuit, where k is an integer and not less than 1.

According to an embodiment of the disclosure, k may be equal to 1.

It is to be noted that k rows of pixel circuits comprise k*M pixel circuits and each row of pixel circuit comprise M pixel circuits. For example, the data voltage output to the current row of pixel circuits by the source driving integrated circuit comprises a data voltage corresponding to each pixel circuit of the current row of pixel circuits. For example, the data voltage output to the first row of pixel circuits as shown in FIG. 2 by the source driving integrated circuit comprises a data voltage corresponding to M pixel circuits of a pixel circuit (1, 1), a pixel circuit (1, 2), . . . , a pixel circuit (1, M), respectively.

According to an embodiment of the disclosure, the method further comprises: obtaining a data voltage to be output to each pixel circuit of k rows of pixel circuits by a source driving integrated circuit according to original red, green and blue data corresponding to all the pixel circuits contained in the k rows of pixel circuits, respectively.

Step S102, determining a maximum voltage of the data voltage to be output to each of the successive k rows of pixel circuits.

Here, the maximum voltage may be a maximum voltage of the data voltages to be output to all the pixel circuits contained in the successive k rows of pixel circuits.

Step S103, determining a magnitude of a power supply voltage required for the source driving integrated circuit to output the data voltages to the successive k rows of pixel circuits in accordance with the maximum voltage.

Here, the power supply voltage required for the source driving integrated circuit to output the data voltages to the successive k rows of pixel circuits is greater than the maximum voltage.

Step S104, supplying the required power supply voltage to the source driving integrated circuit in accordance with the determined magnitude of the required power supply voltage when the source driving integrated circuit outputs the data voltages to the successive k rows of pixel circuits.

According to an embodiment of the disclosure, a magnitude of a power supply voltage required for the source driving integrated circuit to output the data voltages to the successive k rows of pixel circuits is determined in accordance with the maximum voltage of the data voltage to be output to each of the successive k rows of pixel circuits; and the required power supply voltage is supplied to the source driving integrated circuit in accordance with the determined magnitude of the required power supply voltage when the source driving integrated circuit outputs the data voltages to the successive k rows of pixel circuits. This can dynamically adjust the supply voltage supplied to the source driving integrated circuit according to the supply voltage required for the actual operation of the source driving integrated circuit. When a power supply voltage required for an actual operation of the source driving integrated circuit is relatively small, the power supply voltage supplied to the source driving integrated circuit is also relatively small. Compared with the case of always providing a preset magnitude of the power supply voltage to the supply voltage source driving integrated circuit, power consumption of the source driving integrated circuit can be reduced.

Figure 4:
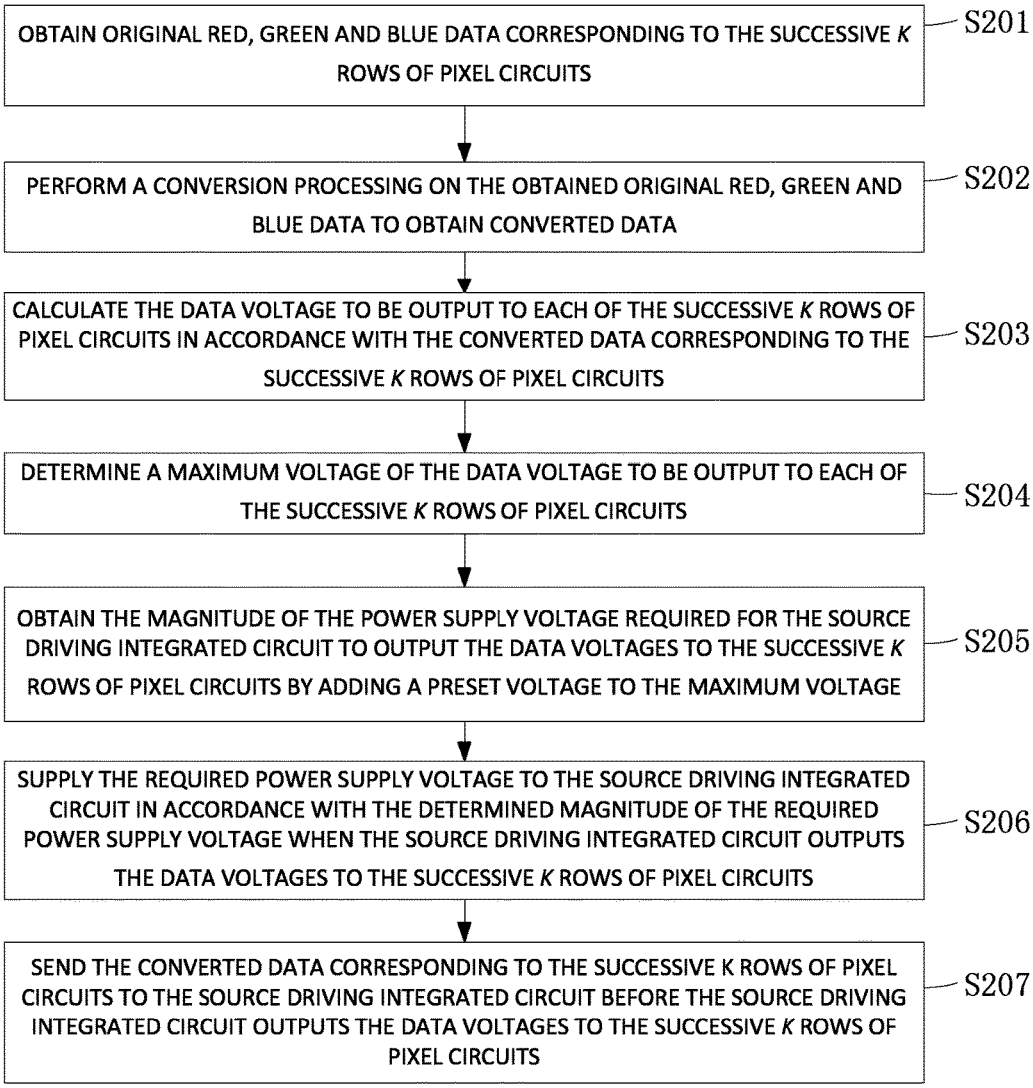
FIG. 4 is a flowchart of a display driving method provided according to another embodiment of the disclosure.

FIG. 4 shows a display driving method according to another embodiment of the disclosure. Compared with the method provided by the embodiment as shown in FIG. 3, in the method of the present embodiment, the original image data corresponding to the pixel circuit is processed firstly, and the power supply voltage is then dynamically provided to the source driving integrated circuit according to the processed image data. Referring to FIG. 4, the method comprises the following steps:

Step S201, obtaining original red, green and blue data corresponding to successive k rows of pixel circuits, wherein k is an integer and not less than 1.

According to an embodiment of the disclosure, k may be equal to 1.

According to an embodiment of the disclosure, the original red, green and blue data corresponding to the successive k rows of pixel circuits comprises original red, green and blue data corresponding to each of the successive k rows of pixel circuits.

According to an embodiment of the disclosure, the original red, green and blue data corresponding to each of the successive k rows of pixel circuits may be obtained from the timing controller 20 as shown in FIG. 1.

It is to be noted that the original red, green and blue data is generally a gray-scale value of each of red, green and blue colors.

Step S202, performing a conversion processing on the obtained original red, green and blue data to obtain converted data.

According to an embodiment of the disclosure, a conversion processing is performed on the obtained original red, green and blue data corresponding to each pixel circuit.

According to an embodiment of the disclosure, performing the conversion processing on the obtained original red, green and blue data is to reduce power consumption of the source driving integrated circuit. As an alternative embodiment, step S202 further comprises converting the obtained original red, green and blue data into red, green, blue and white data.

Specifically, the obtained original red, green and blue data can be converted into red, green, blue and white data by employing RGBW (red, green, blue, white) algorithm. This step S202 may comprise firstly determining a minimum value of the obtained original red, green, and blue data. Second, the obtained original red, green and blue data can be converted into red, green, blue and white data in accordance with the minimum value (for example, the minimum gray-scale value). Here, a value of the white data (i.e. W data) may be a product of the minimum value and a preset ratio, and the preset ratio may be 0~1. The values of the converted red, green and blue data are differences of values of the original red R, green G and blue B data and the value of the W data, respectively. For example, the value of the converted R data is a difference of the value of the original R data and the value of the W data; the value of the converted G data is a difference of the value of the original G data and the value of the W data; and the value of the converted B data is a difference of the value of the original B data and the value of the W data.

In the case of converting the obtained original red, green and blue data into red, green, blue and white data by employing the RGBW algorithm, the effect of displaying image is better, and it is easy to implement the RGBW algorithm.

It is to be noted that, in addition to the conversion processing using the RGBW algorithm, it is possible to adopt a conversion processing method capable of reducing the gray of the image, and the conversion processing method is not limited in the embodiment of the disclosure.

Step S203, calculating the data voltage to be output to each of the successive k rows of pixel circuits in accordance with the converted data corresponding to the successive k rows of pixel circuits.

According to an embodiment of the disclosure, the converted data corresponding to each of the successive k rows of pixel circuits may be converted into a brightness signal, and then the data voltage output to each pixel circuit may be calculated according to the brightness signal.

The data voltage to be output to each of the successive k rows of pixel circuits is obtained by step S201-step S203.

Step S204, determining a maximum voltage of the data voltage to be output to each of the successive k rows of pixel circuits.

According to an embodiment of the disclosure, the maximum voltage may be a maximum voltage of the data voltages to be output to all the pixel circuits contained in the successive k rows of pixel circuits.

Assuming that each row of pixel circuits comprise M pixel circuits (see FIG. 2), if k is 1, the determined maximum voltage is the maximum voltage of the data voltages corresponding to M pixel circuits contained in the single row of pixel circuits. If k is 3, the determined maximum voltage is the maximum voltage of the data voltages corresponding to M*3 pixel circuits contained in the successive three rows of pixel circuits. Assuming that the successive three rows of pixel circuits are the first, the second, and the third pixel circuits, the maximum voltage may be the maximum voltage of the data voltages corresponding to M pixel circuits contained in the first row of pixel circuits, the maximum voltage of the data voltages corresponding to M pixel circuits contained in the second row of pixel circuits, or the maximum voltage of the data voltages corresponding to M pixel circuits contained in the third row of pixel circuits.

Step S205, obtaining the magnitude of the power supply voltage required for the source driving integrated circuit to output the data voltages to the successive k rows of pixel circuits by adding a preset voltage to the maximum voltage.

According to an embodiment of the disclosure, the preset voltage may be an empirical value. For example, statistically, the operating voltage of the source driving integrated circuit is usually higher than the maximum output voltage output to the pixel circuit by the source driving integrated circuit by at least 0.2 V, thus the preset voltage may be greater than or equal to 0.2 V. As an alternative embodiment, the preset voltage may be 0.2 V.

Step S206, supplying the required power supply voltage to the source driving integrated circuit in accordance with the determined magnitude of the required power supply voltage when the source driving integrated circuit outputs the data voltages to the successive k rows of pixel circuits.

According to an embodiment of the disclosure, it is possible to control the power supply module so that the magnitude of the power supply voltage output to the source driving integrated circuit by the power supply module is determined as the determined magnitude of the required power supply voltage.

Step S207, sending the converted data corresponding to the successive k rows of pixel circuits to the source driving integrated circuit before the source driving integrated circuit outputs the data voltages to the successive k rows of pixel circuits.

Since the determined magnitude of the required power supply voltage is obtained according to the converted data corresponding to the successive k rows of pixel circuits, it is necessary to ensure that the source driving integrated circuit calculates the data voltage required for the pixel circuit in accordance with the converted data corresponding to the successive k rows of pixel circuits. To this end, the converted data corresponding to the successive k rows of pixel circuits is sent to the source driving integrated circuit before the source driving integrated circuit outputs the data voltages to the successive k rows of pixel circuits.

It is to be noted that step S206 and step S207 can be executed simultaneously.

The display driving method of the embodiment of the disclosure determines the magnitude of the power supply voltage required for the source driving integrated circuit to output the data voltages to the successive k rows of pixel circuits in accordance with the maximum voltage of the data voltage to be output to each of the successive k rows of pixel circuits, and supplies the required power supply voltage to the source driving integrated circuit in accordance with the determined magnitude of the required power supply voltage when the source driving integrated circuit outputs the data voltages to the successive k rows of pixel circuits. This can dynamically adjust the supply voltage supplied to the source driving integrated circuit according to the supply voltage required for the actual operation of the source driving integrated circuit. When a power supply voltage required for an actual operation of the source driving integrated circuit is relatively small, the power supply voltage supplied to the source driving integrated circuit is also relatively small. Compared with the case of always providing a preset magnitude of the power supply voltage to the supply voltage source driving integrated circuit, power consumption of the source driving integrated circuit can be reduced.

Figure 5:
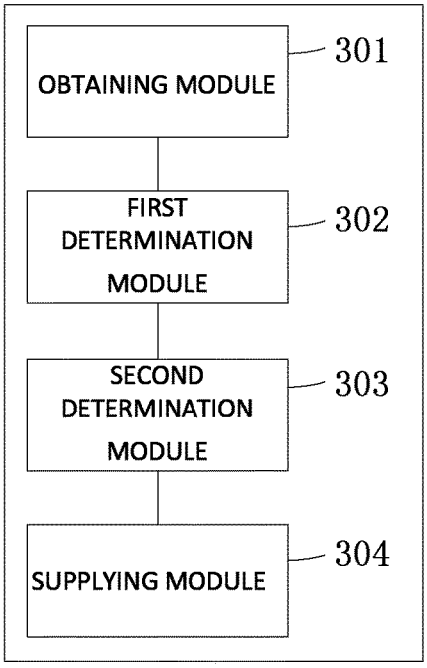
FIG. 5 is a structural schematic diagram of a display driving device provided according to one embodiment of the disclosure.

FIG. 5 shows a display driving device provided according to one embodiment of the disclosure. This device can be disposed in the timing controller 20 as shown in FIG. 1, and is applicable to the method provided by the embodiment shown in FIG. 3 or 4. Referring to FIG. 5, this device comprises an obtaining module 301, a first determination module 302, a second determination module 303 and a supplying module 304.

The obtaining module 301 is arranged to obtain a data voltage to be output to each of successive k rows of pixel circuits by a source driving integrated circuit; k is an integer and not less than 1.

The first determination module 302 is arranged to determine a maximum voltage of the data voltage to be output to each of the successive k rows of pixel circuits.

The second determination module 303 is arranged to determine a magnitude of a power supply voltage required for the source driving integrated circuit to output the data voltages to the successive k rows of pixel circuits in accordance with the maximum voltage.

The supplying module 304 is arranged to supply the required power supply voltage to the source driving integrated circuit in accordance with the determined magnitude of the required power supply voltage when the source driving integrated circuit outputs the data voltages to the successive k rows of pixel circuits.

The display driving device according to the embodiment of the disclosure determines the magnitude of the power supply voltage required for the source driving integrated circuit to output the data voltages to the successive k rows of pixel circuits in accordance with the maximum voltage of the data voltage to be output to each of the successive k rows of pixel circuits, and supplies the required power supply voltage to the source driving integrated circuit in accordance with the determined magnitude of the required power supply voltage when the source driving integrated circuit outputs the data voltages to the successive k rows of pixel circuits. This can dynamically adjust the supply voltage supplied to the source driving integrated circuit according to the supply voltage required for the actual operation of the source driving integrated circuit. When a power supply voltage required for an actual operation of the source driving integrated circuit is relatively small, the power supply voltage supplied to the source driving integrated circuit is also relatively small. Compared with the case of always providing a preset magnitude of the power supply voltage to the supply voltage source driving integrated circuit, power consumption of the source driving integrated circuit can be reduced.

Figure 6:
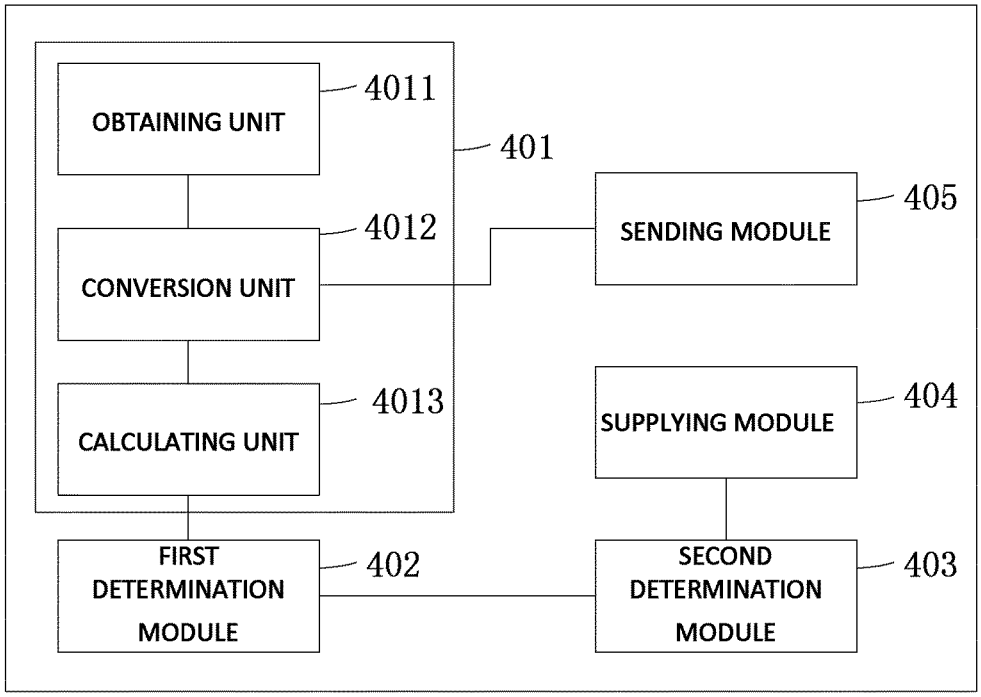
FIG. 6 is a structural schematic diagram of a display driving device provided according to another embodiment of the disclosure.

FIG. 6 shows a display driving device provided according to another embodiment of the disclosure. This device can be disposed in the timing controller 20 as shown in FIG. 1, and is applicable to the method provided by the embodiment shown in FIG. 4. Referring to FIG. 6, this device comprises an obtaining module 401, a first determination module 402, a second determination module 403 and a supplying module 404. Here, the first determination module 402 and the supplying module 404 are same as the first determination module 302 and the supplying module 304 shown in FIG. 5, respectively, and thus will not repeated here. The device provided in this embodiment is different from the device shown in FIG. 5 as follows.

The second determination module 403 is arranged to obtain the magnitude of the power supply voltage required for the source driving integrated circuit to output the data voltages to the successive k rows of pixel circuits by adding a preset voltage to the maximum voltage.

According to an embodiment of the disclosure, the preset voltage is greater than or equal to 0.2 V.

According to an embodiment of the disclosure, the obtaining module 401 comprises an obtaining unit 4011, a conversion unit 4012 and a calculating unit 4013.

The obtaining unit 4011 is arranged to obtain original red, green and blue data corresponding to the successive k rows of pixel circuits.

The conversion unit 4012 is arranged to perform a conversion processing on the obtained original red, green and blue data to obtain converted data.

According to an embodiment of the disclosure, the conversion unit 4012 is arranged to determine a minimum value of the obtained original red, green, and blue data, and converts the obtained original red, green and blue data into red, green, blue and white data in accordance with the minimum value, a value of the white data is equal to a product of the minimum value and a preset ratio, and values of the converted red, green and blue data are differences of values of the original red, green and blue data and the value of the white data, respectively.

The calculating unit 4013 is arranged to compute the data voltage to be output to each of the successive k rows of pixel circuits in accordance with the converted data corresponding to the successive k rows of pixel circuits.

According to an embodiment of the disclosure, this device further comprises a sending module 405.

The sending module 405 is arranged to send the converted data corresponding to the successive k rows of pixel circuits to the source driving integrated circuit before the source driving integrated circuit outputs the data voltages to the successive k rows of pixel circuits.

The display driving device according to the embodiment of the disclosure determines the magnitude of the power supply voltage required for the source driving integrated circuit to output the data voltages to the successive k rows of pixel circuits in accordance with the maximum voltage of the data voltage to be output to each of the successive k rows of pixel circuits, and supplies the required power supply voltage to the source driving integrated circuit in accordance with the determined magnitude of the required power supply voltage when the source driving integrated circuit outputs the data voltages to the successive k rows of pixel circuits. This can dynamically adjust the supply voltage supplied to the source driving integrated circuit according to the supply voltage required for the actual operation of the source driving integrated circuit. When a power supply voltage required for an actual operation of the source driving integrated circuit is relatively small, the power supply voltage supplied to the source driving integrated circuit is also relatively small. Compared with the case of always providing a preset magnitude of the power supply voltage to the supply voltage source driving integrated circuit, power consumption of the source driving integrated circuit can be reduced.

Figure 7:
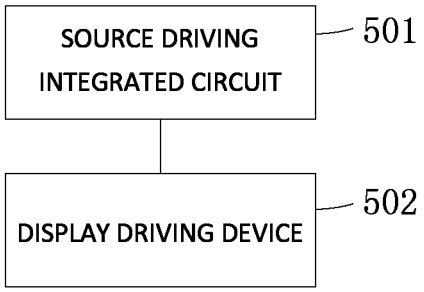
FIG. 7 is a structural schematic diagram of a display device provided according to one embodiment of the disclosure.

FIG. 7 shows a display device provided according to an embodiment of the disclosure. Referring to FIG. 7, the display device comprises a source driving integrated circuit 501 and a display driving device 502.

Here, the display driving device 502 may be the display driving device provided by the embodiment shown in FIG. 5 or 6, and thus will not repeated here.

The display device of the embodiment of the disclosure determines the magnitude of the power supply voltage required for the source driving integrated circuit to output the data voltages to the successive k rows of pixel circuits in accordance with the maximum voltage of the data voltage to be output to each of the successive k rows of pixel circuits, and supplies the required power supply voltage to the source driving integrated circuit in accordance with the determined magnitude of the required power supply voltage when the source driving integrated circuit outputs the data voltages to the successive k rows of pixel circuits. This can dynamically adjust the supply voltage supplied to the source driving integrated circuit according to the supply voltage required for the actual operation of the source driving integrated circuit. When a power supply voltage required for an actual operation of the source driving integrated circuit is relatively small, the power supply voltage supplied to the source driving integrated circuit is also relatively small. Compared with the case of always providing a preset magnitude of the power supply voltage to the supply voltage source driving integrated circuit, power consumption of the source driving integrated circuit can be reduced.

It is to be noted that the display driving device provided according to the embodiments described as above is only exemplified by the division of each of the above described functional modules in executing the display driving. In practice, the above functions may be assigned to be performed by different functional modules as required, that is, the internal structure of the device is divided into different functional modules to complete all or part of the functions described as above. In addition, the display driving device and the display driving method provided by the embodiments described as above belong to the same inventive concept, the specific implementations thereof are described in detail in the device and method embodiments, and thus will not repeated here.

It will be appreciated by those of ordinary skill in the art that all or part of the steps of implementing the embodiments described as above may be accomplished by a hardware or may be accomplished by a relevant hardware instructed by a program that is stored in a computer-readable storage medium. The storage medium mentioned as above may be a read-only memory, a magnetic disk, an optical disk, or the like.

The above description is only specific embodiments of the disclosure, but the scope of the disclosure is not limited thereto. Changes or replacements within the technical scope of the disclosure, which can be easily acquired by any skilled in the art, should be encompassed within the scope of the disclosure. Accordingly, the scope of the disclosure should be based on the scope of the claims attached.

The invention claimed is:

1. A display driving method comprising:

obtaining a data voltage to be output to each of successive k rows of pixel circuits by a source driving integrated circuit, where k is an integer and not less than 1;

determining a maximum voltage of the data voltage to be output to each of the successive k rows of pixel circuits;

determining a magnitude of a power supply voltage required for the source driving integrated circuit to output the data voltage to the successive k rows of pixel circuits by adding a preset voltage to the maximum voltage; and supplying the required power supply voltage to the source driving integrated circuit in accordance with the determined magnitude of the required power supply voltage when the source driving integrated circuit outputs the data voltage to the successive k rows of pixel circuits.

2. The method of claim 1, wherein the preset voltage is greater than or equal to 0.2 V.

3. The method of claim 2, wherein obtaining the data voltage to be output to each of the successive k rows of pixel circuits by the source driving integrated circuit comprises:

obtaining original red, green and blue data corresponding to the successive k rows of pixel circuits;

performing a conversion processing on the obtained original red, green and blue data to obtain converted data; and calculating the data voltage to be output to each of the successive k rows of pixel circuits in accordance with the converted data corresponding to the successive k rows of pixel circuits.

4. The method of claim 3, wherein performing the conversion processing on the obtained original red, green and blue data to obtain converted data comprises:

determining a minimum value of the obtained original red, green, and blue data; and converting the obtained original red, green and blue data into red, green, blue and white data in accordance with the minimum value, wherein a value of the white data is equal to a product of the minimum value and a preset ratio, and values of the converted red, green and blue data are differences of values of the original red, green and blue data and the value of the white data, respectively.

5. The method of claim 1, wherein obtaining the data voltage to be output to each of the successive k rows of pixel circuits by the source driving integrated circuit comprises:

obtaining original red, green and blue data corresponding to the successive k rows of pixel circuits;

performing conversion processing on the obtained original red, green and blue data to obtain converted data; and calculating the data voltage to be output to each of the successive k rows of pixel circuits in accordance with the converted data corresponding to the successive k rows of pixel circuits.

6. The method of claim 5, wherein performing the conversion processing on the obtained original red, green and blue data to obtain converted data comprises:

determining a minimum value of the obtained original red, green, and blue data; and converting the obtained original red, green and blue data into red, green, blue and white data in accordance with the minimum value, wherein a value of the white data is equal to a product of the minimum value and a preset ratio, and values of the converted red, green and blue data are differences of values of the original red, green and blue data and the value of the white data, respectively.

7. The method of claim 6, further comprising:

sending the converted data corresponding to the successive k rows of pixel circuits to the source driving integrated circuit before the source driving integrated circuit outputs the data voltage to the successive k rows of pixel circuits.

8. The method of claim 5, further comprising:

sending the converted data corresponding to the successive k rows of pixel circuits to the source driving integrated circuit before the source driving integrated circuit outputs the data voltage to the successive k rows of pixel circuits.

9. A display driving device comprising:

a controller including hardware configured to execute a computer-readable program to:

obtain a data voltage to be output to each of successive k rows of pixel circuits by a source driving integrated circuit, where k is an integer and not less than 1;

determine a maximum voltage of the data voltage to be output to each of the successive k rows of pixel circuits;

determine a magnitude of a power supply voltage required for the source driving integrated circuit to output the data voltage to the successive k rows of pixel circuits by adding a preset voltage to the maximum voltage; and supply the required power supply voltage to the source driving integrated circuit in accordance with the determined magnitude of the required power supply voltage when the source driving integrated circuit outputs the data voltage to the successive k rows of pixel circuits.

10. The device of claim 9, wherein the preset voltage is greater than or equal to 0.2 V.

11. The device of claim 10, wherein the hardware of the controller is configured to execute the computer-readable program to:

obtain original red, green and blue data corresponding to the successive k rows of pixel circuits;

perform conversion processing on the obtained original red, green and blue data to obtain converted data; and calculate the data voltage to be output to each of the successive k rows of pixel circuits in accordance with the converted data corresponding to the successive k rows of pixel circuits.

12. The device of claim 11, wherein the hardware of the controller is configured to execute the computer-readable program to send the converted data corresponding to the successive k rows of pixel circuits to the source driving integrated circuit before the source driving integrated circuit outputs the data voltage to the successive k rows of pixel circuits.

13. The device of claim 9, wherein the hardware of the controller is configured to execute the computer-readable program to:

obtain original red, green and blue data corresponding to the successive k rows of pixel circuits;

perform conversion processing on the obtained original red, green and blue data to obtain converted data; and calculate the data voltage to be output to each of the successive k rows of pixel circuits in accordance with the converted data corresponding to the successive k rows of pixel circuits.

14. The device of claim 13, wherein the hardware of the controller is configured to execute the computer-readable program to:

determine a minimum value of the obtained original red, green, and blue data; and convert the obtained original red, green and blue data into red, green, blue and white data in accordance with the minimum value, wherein a value of the white data is equal to a product of the minimum value and a preset ratio, and values of the converted red, green and blue data are differences of values of the original red, green and blue data and the value of the white data, respectively.

15. The device of claim 13, wherein the hardware of the controller is configured to execute the computer-readable program to send the converted data corresponding to the successive k rows of pixel circuits to the source driving integrated circuit before the source driving integrated circuit outputs the data voltage to the successive k rows of pixel circuits.

16. A display device comprising a source driving integrated circuit and the display driving device of claim 9.

17. The display device of claim 16, wherein the hardware of the controller is configured to execute the computer-readable program to:

obtain original red, green and blue data corresponding to the successive k rows of pixel circuits;

perform conversion processing on the obtained original red, green and blue data to obtain converted data; and calculate the data voltage to be output to each of the successive k rows of pixel circuits in accordance with the converted data corresponding to the successive k rows of pixel circuits.

18. The device of claim 17, wherein the hardware of the controller is configured to execute the computer-readable program to send the converted data corresponding to the successive k rows of pixel circuits to the source driving integrated circuit before the source driving integrated circuit outputs the data voltage to the successive k rows of pixel circuits.

* * * * *